US010512369B2

(12) United States Patent
Cuenca et al.

(10) Patent No.: US 10,512,369 B2
(45) Date of Patent: Dec. 24, 2019

(54) TOILET PAPER ROLL HOLDER ATTACHMENT SYSTEM

(71) Applicants: Jojo De Vera Cuenca, San Francisco, CA (US); Joel Asuncion Dionisio, Daly City, CA (US)

(72) Inventors: Jojo De Vera Cuenca, San Francisco, CA (US); Joel Asuncion Dionisio, Daly City, CA (US)

( * ) Notice: Subject to any disclaimer, the term of this patent is extended or adjusted under 35 U.S.C. 154(b) by 95 days.

(21) Appl. No.: 15/346,733

(22) Filed: Nov. 9, 2016

(65) Prior Publication Data

US 2018/0125308 A1 May 10, 2018

(51) Int. Cl.
*A47K 10/22* (2006.01)
*A47K 10/38* (2006.01)
*A47K 10/32* (2006.01)

(52) U.S. Cl.
CPC ..... *A47K 10/22* (2013.01); *A47K 10/3836* (2013.01); *A47K 2010/324* (2013.01); *A47K 2010/3253* (2013.01)

(58) Field of Classification Search
CPC ..... A47K 10/22
USPC ..... 242/597, 597.7, 55.2, 597.8
See application file for complete search history.

(56) References Cited

U.S. PATENT DOCUMENTS 671,576 A * 4/1901 Barnett ..... B65H 23/06 242/422.4
1,586,274 A * 5/1926 Welch ..... A47K 10/38 242/596
2,240,629 A * 5/1941 Smith ..... A47K 10/3836 242/592
2,467,825 A * 4/1949 Hall ..... A47K 10/22 242/596.1
2,482,871 A * 9/1949 Rapport ..... A47K 10/22 242/571.5
2,685,365 A * 8/1954 Sieven ..... A47K 10/38 206/410
2,697,562 A * 12/1954 Langer ..... A47K 10/3836 242/594.5
2,790,608 A * 4/1957 Sieven ..... A47K 10/32 242/560
2,858,995 A * 11/1958 Sarro ..... A47K 10/3836 211/123
3,184,176 A 5/1965 Tucker et al.
3,335,973 A 8/1967 Genn
3,398,908 A 8/1968 Thompson
(Continued)

*Primary Examiner* — Michael R Mansen
*Assistant Examiner* — Mark K Buse
(74) *Attorney, Agent, or Firm* — Patential; Keum J. Park

(57) ABSTRACT

A toilet paper roll holder attachment system is disclosed for supporting the holding of at least two toilet paper rolls in either horizontal or vertical configuration or for supporting the holding of large or jumbo toilet paper rolls. The toilet paper roll holder attachment system has a hollow cylindrical body with two substantially round apertures which are adapted for holding a toilet paper roll spindle. There is a vertical support arm or support bracket extending perpendicularly downward from the hollow cylindrical body. At the lower end of the vertical support arm or support bracket is a horizontal rod for holding the toilet paper rolls. There is(are) stopper(s) at the end(s) of the horizontal rod for the purpose of preventing the toilet paper rolls from sliding out of the horizontal rod.

9 Claims, 11 Drawing Sheets

(56) References Cited

U.S. PATENT DOCUMENTS 3,792,822 A * 2/1974 Underhill ..... A47K 10/3836 211/59.1
3,824,953 A * 7/1974 Boone ..... A47K 10/32 118/506
3,837,595 A * 9/1974 Boone ..... A47K 10/32 242/594.5
3,991,458 A * 11/1976 Donoff ..... B65H 75/005 29/234
D252,842 S 9/1979 McKee
4,427,159 A * 1/1984 Miller ..... A47K 10/38 242/560
D277,347 S * 1/1985 Thompson ..... D6/523
4,690,343 A * 9/1987 Goetz ..... A47K 10/3836 242/594.3
4,747,561 A * 5/1988 Sweeny ..... B65H 75/22 242/396.3
4,767,074 A * 8/1988 Bower ..... A47K 10/3836 242/594.5
4,834,316 A * 5/1989 DeLorean ..... A47K 10/32 242/594
4,878,631 A * 11/1989 Tanovici ..... B65H 23/06 242/423.1
5,012,986 A * 5/1991 Needle ..... A47K 10/38 242/560
5,301,888 A * 4/1994 Danzi ..... A47K 10/22 242/560
5,605,250 A * 2/1997 Meiron ..... A47K 10/38 221/33
5,653,403 A * 8/1997 Ritchey ..... A47K 10/3836 242/597.5
5,718,396 A * 2/1998 Maresca ..... A47K 10/38 242/598.2
5,765,775 A * 6/1998 Keserica ..... A47K 10/38 242/597
D406,481 S * 3/1999 Conrado ..... D6/520
5,897,074 A 4/1999 Marino
D452,094 S * 12/2001 Akin ..... D6/515
6,460,799 B1 * 10/2002 Ryan ..... A47K 10/38 242/560.2
6,698,683 B2 * 3/2004 Young ..... A47K 10/3836 242/594
6,805,271 B2 * 10/2004 Holden ..... A47K 10/38 206/409
6,945,493 B1 * 9/2005 Gottesman ..... A47K 10/38 242/560.2
7,392,917 B2 * 7/2008 Alalu ..... A47K 10/16 221/48
7,438,255 B2 * 10/2008 Burnett ..... A47K 10/3836 242/597.5
8,550,296 B2 * 10/2013 Gerschwiler Steck ..... A47K 10/42 221/283
9,198,545 B2 * 12/2015 D'Angelo ..... A47K 10/38
2006/0180698 A1 * 8/2006 Hensley ..... A47K 10/22 242/560
2007/0102444 A1 * 5/2007 Robinson ..... A47K 10/22 221/309
2011/0210198 A1 * 9/2011 Case ..... A47K 10/38 242/598
2012/0261506 A1 * 10/2012 Buelow ..... A47K 10/40 242/597.8
2016/0256018 A1 * 9/2016 Viessman ..... A47K 10/3836

* cited by examiner

TOILET PAPER ROLL HOLDER ATTACHMENT SYSTEM

CROSS REFERENCE TO RELATED APPLICATIONS

Not Applicable

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention generally relates to paper holding devices, and more particularly to a toilet paper holding attachment system device that simultaneously holds at least two rolls of toilet paper, that can either be in a horizontal or vertical configuration, or for holding large or jumbo size toilet paper rolls that can be used with a pre-existing toilet paper roll spindle in a conventional wall-mounted toilet paper roll spindle bracket.

2. Description of Related Arts

The following related arts have shown different toilet paper roll holders that allow the holding of at least two rolls of toilet paper: U.S. D406,481 teaches a hanger that uses a pair of support arms with hooks at either end for hanging a second toilet paper roll spindle. U.S. Pat. Nos. 2,685,365 and 2,790,608 teach a supporting bracket for mounting a replacement tissue roll onto a pre-existing toilet paper spindle. The supporting bracket includes a pair of support arms that hook over the pre-existing toilet paper spindle. U.S. Pat. No. 3,335,973 teaches a paper dispensing machine that includes a pair of pivot arms to alternately dispense a pair of toilet paper rolls.

Related arts teach various devices for holding a second roll of toilet paper in proximity to a first toilet paper roll; however, the related arts do not teach a paper holding device that easily slides over a pre-existing toilet paper roll spindle used in a conventional wall-mounted toilet paper roll spindle bracket that supports the holding of at least two toilet paper rolls in either horizontal or vertical configurations or that supports the holding of large or jumbo size toilet paper rolls.

A need; therefore, exists for an improved, simple, and, easy to use toilet paper holder device that supports the holding of at least two toilet paper rolls simultaneously or supports the holding of large or jumbo size toilet paper rolls.

The present invention provides an improved, simple, and easy to use device that can hold at least two toilet paper rolls in either horizontal or vertical configurations or that supports large or jumbo size toilet paper rolls using a pre-existing toilet paper roll spindle in its conventional wall-mounted toilet paper roll spindle bracket.

BRIEF SUMMARY OF THE INVENTION

The present invention is an improved device for a toilet paper roll holder attachment system that can hold at least two toilet paper rolls simultaneously in either horizontal or vertical configuration or for holding large size or jumbo toilet paper rolls that can be used with the pre-existing toilet paper roll spindle in its conventional wall-mounted toilet paper roll spindle bracket.

It is a principal object of the invention to provide an improved, simple, and, easy to use toilet paper holder attachment system device in a horizontal or vertical configuration that can support the holdings of at least two toilet paper rolls or for holding large size or jumbo toilet paper rolls that can be used with the pre-existing toilet paper roll spindle in a conventional wall-mounted toilet paper roll spindle bracket.

In one embodiment, a horizontal dual toilet paper roll holder attachment system is disclosed, featuring: a) a hollow, cylindrical body for the purpose of inserting a pre-existing toilet paper roll spindle, b) a vertical support arm which has an upper end and a lower end, and c) a horizontal shaft that projects freely outwards at its two ends, and the two free ends are angled upwards for the purpose of preventing the toilet paper rolls from sliding out of the horizontal shaft.

In another embodiment, a vertical dual toilet paper roll holder attachment system is disclosed, featuring: d) a hollow, cylindrical body for the purpose of insertion of a pre-existing toilet paper roll spindle, e) a vertical support arm which has an upper end and a lower end, and f) a horizontal shaft that projects freely outward at its end, and the free end is angled upwards for the purpose of preventing the toilet paper roll from sliding out of the horizontal shaft.

In another embodiment, a large size or jumbo toilet paper roll holder attachment system is disclosed, featuring: g) a hollow, cylindrical body for the purpose of insertion of a pre-existing toilet paper roll spindle, h) an inverted L-shaped bracket having an upper horizontal arm and a lower end, and i) a horizontal shaft that projects freely outward at its end, and the free end is angled upwards for the purpose of preventing the large or jumbo size toilet paper roll from sliding out of the horizontal shaft.

Other aspects and objects of the present invention will become apparent from the following detailed description of the invention as illustrated in the accompanying drawings and appended claims.

BRIEF DESCRIPTION OF THE SEVERAL VIEWS OF THE DRAWINGS

The present invention may be more readily described with reference to the accompanying drawings, in which.

DETAILED DESCRIPTION OF THE INVENTION

Figure 1:
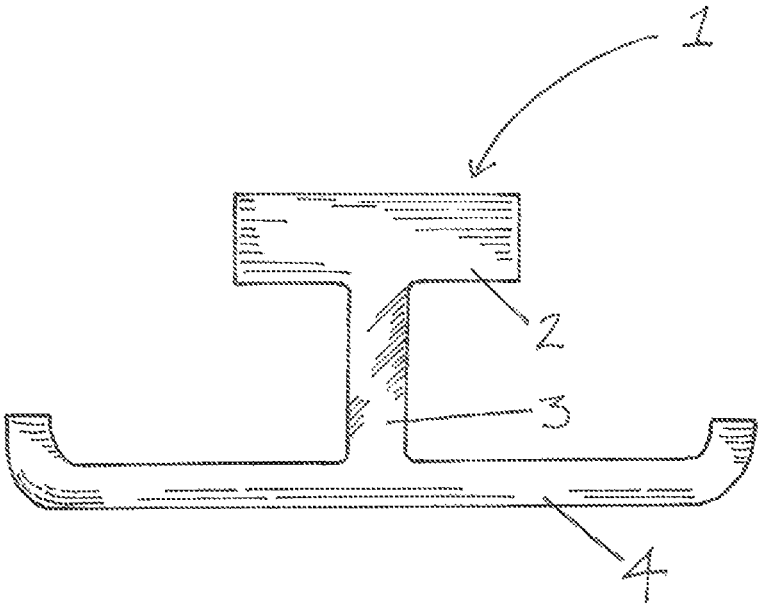
FIG. 1 is a perspective frontal view of a horizontal dual toilet paper roll holder attachment system.
Figure 2:
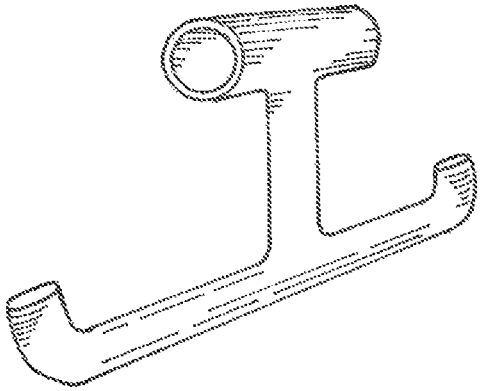
FIG. 2 is a perspective diagonal view of a horizontal dual toilet paper roll holder attachment system.
Figure 3:
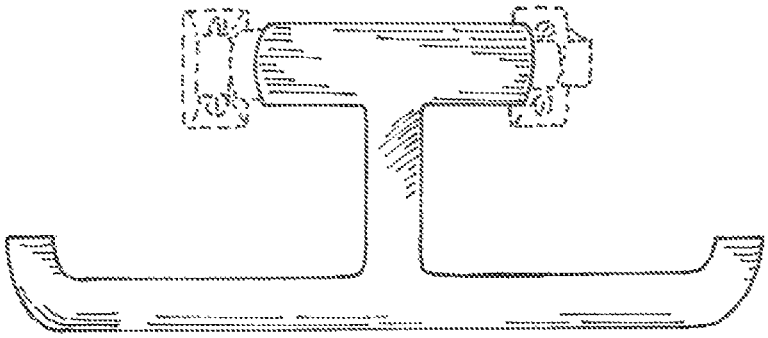
FIG. 3 is a perspective frontal view of a horizontal dual toilet paper roll holder attachment system with a pre-existing toilet paper roll spindle positioned through the hollow, cylindrical body which is attached to a conventional wall mounted toilet paper roll spindle bracket.
Figure 4:
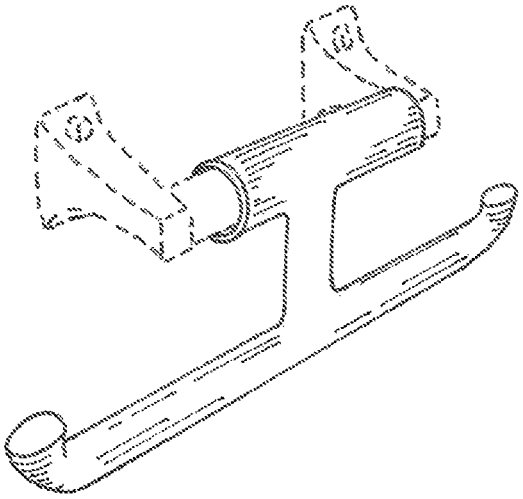
FIG. 4 is a perspective diagonal view of a horizontal dual toilet paper roll holder attachment system with a pre-existing toilet paper roll spindle positioned through the hollow, cylindrical body which is attached to a conventional wall mounted toilet paper roll spindle bracket.
Figure 5:
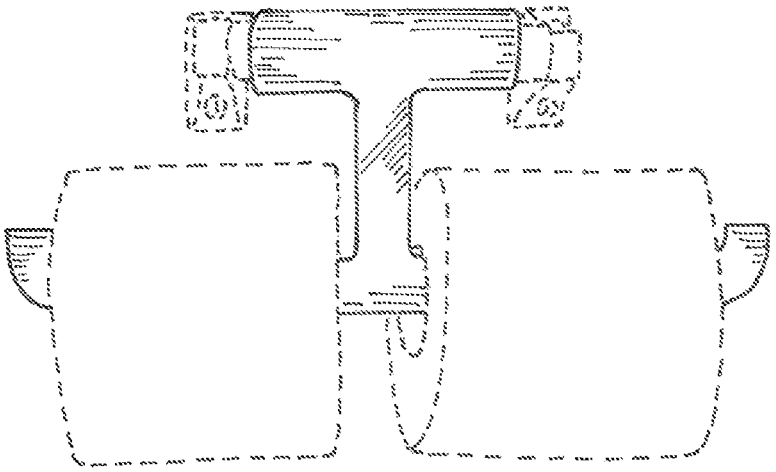
FIG. 5 is a perspective frontal view of a horizontal dual toilet paper roll holder attachment system with a pre-existing toilet paper roll spindle positioned through the hollow cylindrical body which is attached to a conventional wall mounted toilet paper roll spindle bracket with two toilet paper rolls hanging onto the horizontal shaft.
Figure 6:
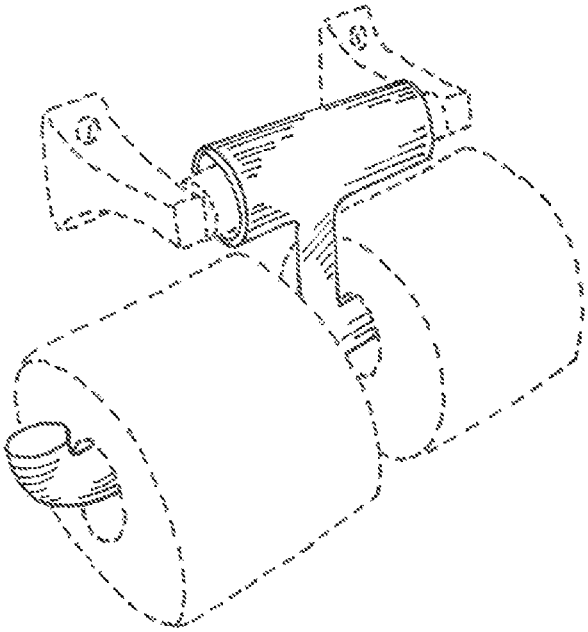
FIG. 6 is a perspective diagonal view of a horizontal dual toilet paper roll holder attachment system with a pre-existing toilet paper roll spindle positioned through the hollow cylindrical body which is attached to a conventional wall mounted toilet paper roll spindle bracket with two toilet paper rolls hanging onto the horizontal shaft.

As shown in the embodiment of FIG. 1, a horizontal dual toilet paper roll holder attachment system in accordance with the present invention is shown at 1. The horizontal dual toilet paper roll holder attachment 1 comprises: a) hollow cylindrical body 2, for the purpose of insertion of a pre-existing toilet paper roll spindle, b) a vertical support arm 3, having an upper end and a lower end, and c) a horizontal shaft 4.

Referring to FIG. 1, the hollow, cylindrical body 2 is shorter in length than that of a pre-existing toilet paper roll spindle for the purpose of easy handling when detaching and attaching the pre-existing toilet paper roll spindle into and out of the conventional wall-mounted toilet paper roll spindle bracket, once the pre-existing toilet paper roll spindle is positioned through the hollow cylindrical body 2.

Referring to FIG. 1, the apertures of both ends of the hollow cylindrical body 2 are larger than the diameter of the pre-existing toilet paper roll spindle for the purpose of having additional area of space for the insertion of the pre-existing toilet paper roll spindle through the hollow cylindrical body 2.

Referring to FIG. 1, the vertical support arm 3, has an adequate vertical length to have a margin between the bottom side of the hollow cylindrical body 2 and the top sides of the two full toilet paper rolls.

Referring to FIG. 1, the upper end of the vertical support arm 3 is connected onto the middle section of the hollow cylindrical body 2, Referring to FIG. 1, the horizontal shaft 4 is connected to the lower end of the vertical support arm 3.

Referring to FIG. 1, the lower end of the vertical support arm 3 is connected onto the middle section of the horizontal shaft 4.

Referring to FIG. 1, the two free ends of the horizontal rod 4 are angled upward for the purpose of preventing the toilet paper rolls from sliding out of the horizontal shaft 4.

Figure 7:
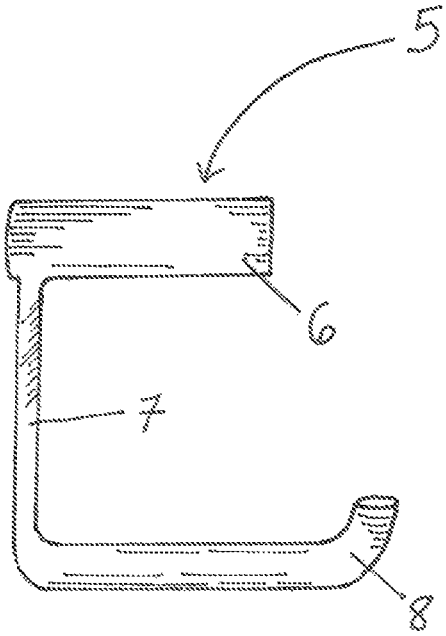
FIG. 7 is a perspective frontal view of a vertical dual toilet paper roll holder attachment system.
Figure 8:
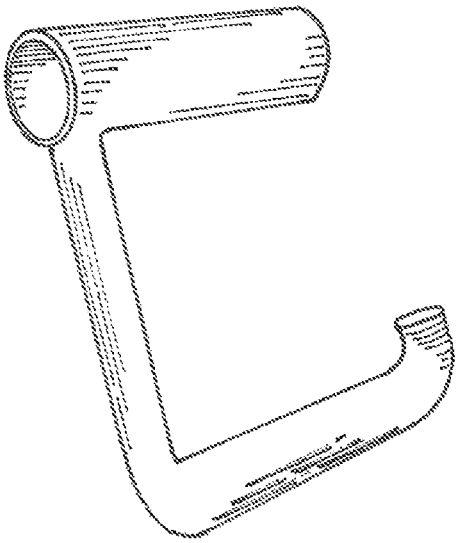
FIG. 8 is a perspective diagonal view of a vertical dual toilet paper roll holder attachment system.
Figure 9:
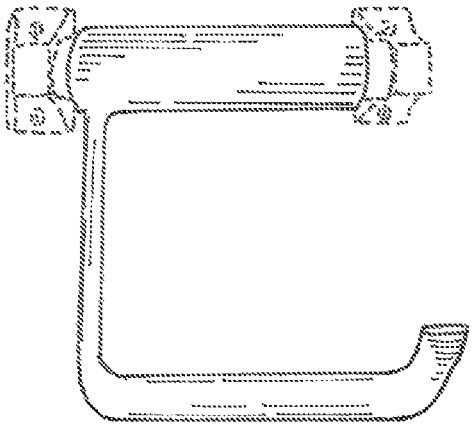
FIG. 9 is a perspective frontal view of a vertical dual toilet paper roll holder attachment system with a pre-existing toilet paper roll spindle positioned through the hollow, cylindrical body which is attached onto a conventional toilet paper roll spindle bracket.
Figure 10:
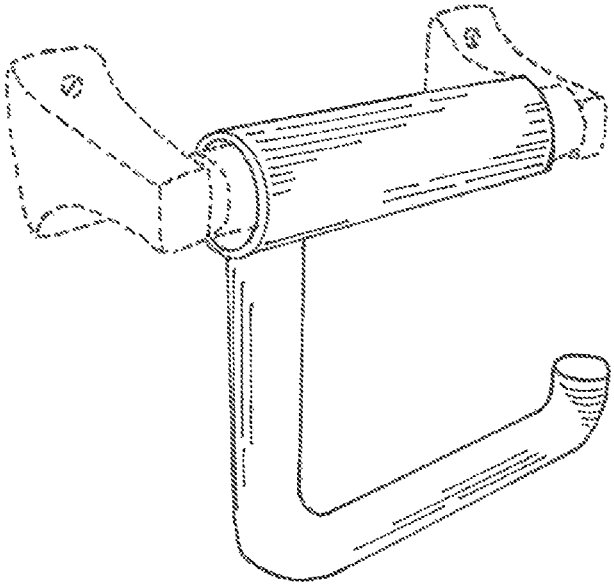
FIG. 10 is a perspective diagonal view of a vertical dual toilet paper roll holder attachment system with a pre-existing toilet paper roll spindle positioned through the hollow, cylindrical body which is attached onto a conventional toilet paper roll spindle bracket.
Figure 11:
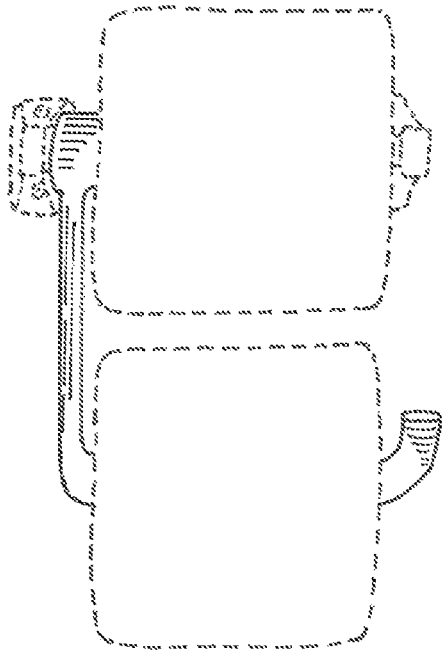
FIG. 11 is a perspective frontal view of a vertical dual toilet paper roll holder attachment system with a pre-existing toilet paper roll spindle positioned through the hollow, cylindrical body with a toilet paper roll hanging onto it, and another toilet paper roll hanging onto the horizontal shaft of the lower end of the vertical support arm.
Figure 12:
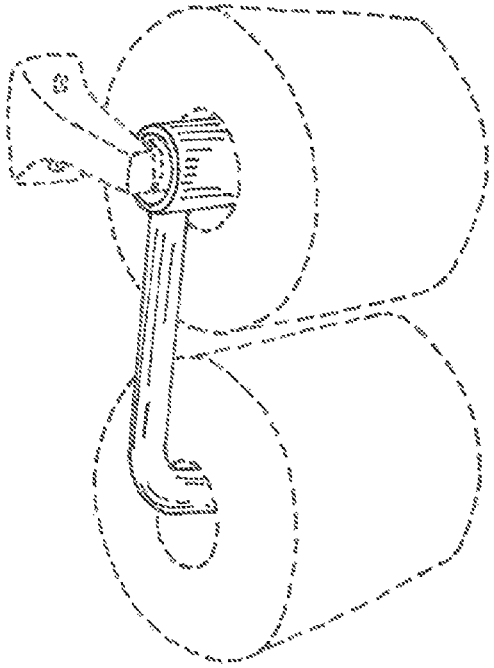
FIG. 12 is a perspective diagonal view of a vertical dual toilet paper roll holder attachment system with a pre-existing toilet paper roll spindle positioned through the hollow, cylindrical body with a toilet paper roll hanging onto it, and another toilet paper roll hanging onto the horizontal shaft of the lower end of the vertical support arm.
Figure 13:
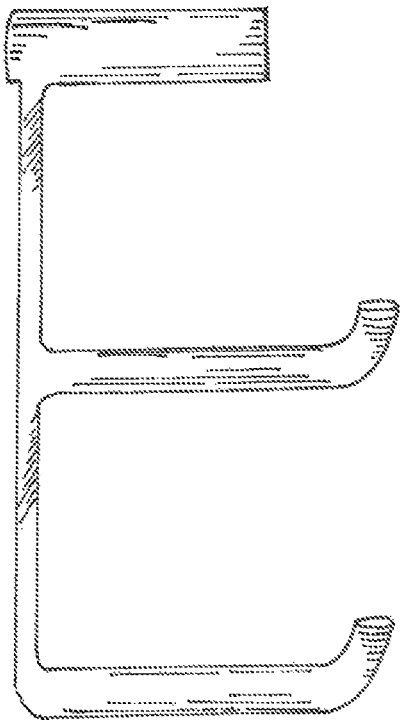
FIG. 13 is a perspective frontal view of a vertical toilet paper roll holder attachment system with an optional second horizontal shaft for supporting at least three toilet paper rolls simultaneously.
Figure 14:
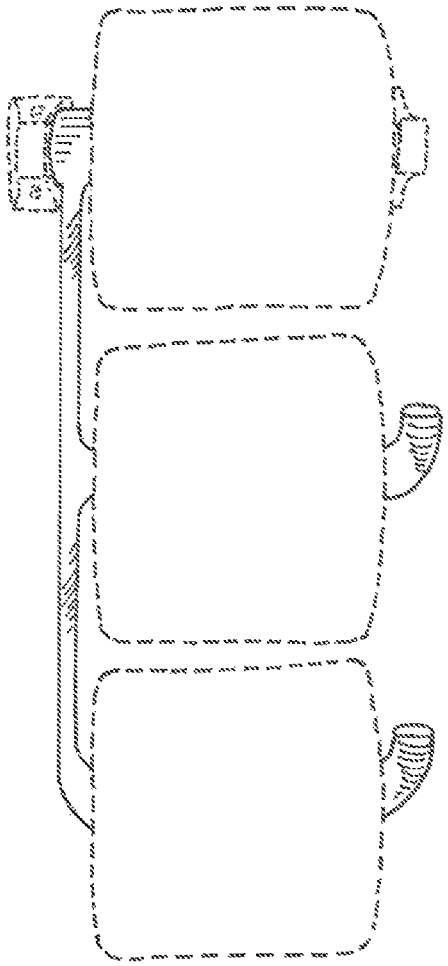
FIG. 14 is a perspective frontal view of a vertical toilet paper roll holder attachment system with an optional second horizontal shaft for supporting at least three toilet paper rolls simultaneously, with toilet paper rolls hanging it, which is attached onto a conventional toilet paper roll spindle bracket.

As shown in the embodiment of FIG. 7, a vertical dual toilet paper roll holder attachment system in accordance to the present invention is shown at 5. The vertical dual toilet paper roll holder attachment system 5 comprises: d) hollow cylindrical body 6, for the purpose of insertion of the pre-existing toilet paper roll spindle, e) a vertical support arm 7, which has an upper end and a lower end, and f) a horizontal shaft 8.

Referring to FIG. 7, the hollow, cylindrical body 6 is shorter in length than that of a pre-existing toilet paper roll spindle for easy handling when detaching and attaching the pre-existing toilet paper roll spindle into and out of the conventional wall-mounted toilet paper roll spindle bracket, once the pre-existing toilet paper roll spindle is positioned through the hollow cylindrical body 6.

Referring to FIG. 7, the apertures of both ends of the hollow cylindrical body 6 are larger than the diameter of the pre-existing toilet paper roll spindle for the purpose of having additional area of space for the insertion of the pre-existing toilet paper roll spindle through the hollow cylindrical body 6.

Referring to FIG. 7, the vertical support arm 7, has an adequate vertical length to have a margin between the bottom side of the first full toilet paper roll positioned on the top toilet paper roll spindle and the top side of the second full toilet paper roll positioned on the horizontal shaft 8.

Referring to FIG. 7, the upper end of the vertical support arm 7 is connected to one end of the hollow cylindrical body 6.

Referring to FIG. 7, the lower end of the vertical support arm 7, is connected to one end of the horizontal shaft 8.

Referring to FIG. 7, the free end of the horizontal shaft 8 is angled upwards for the purpose of preventing the toilet paper roll from sliding out of the horizontal shaft 8.

Figure 15:
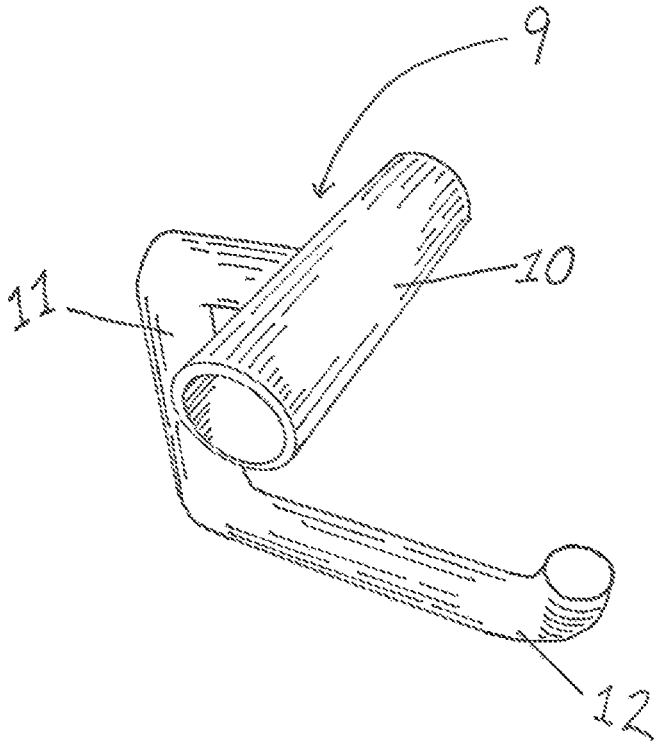
FIG. 15 is a perspective semi top and diagonal view of a jumbo toilet paper roll holder attachment system.
Figure 16:
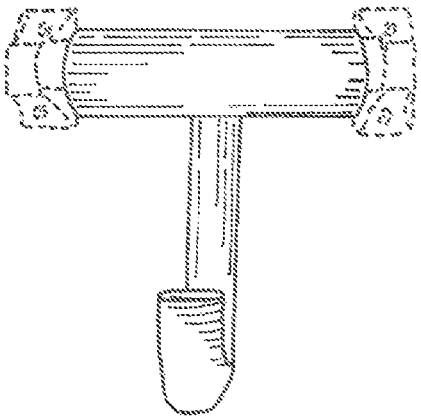
FIG. 16 is a perspective frontal view of a jumbo toilet paper roll holder attachment system with a pre-existing toilet paper roll spindle positioned through the hollow, cylindrical body, with a toilet paper roll hanging onto it, which is attached onto a conventional toilet paper roll spindle bracket.
Figure 17:
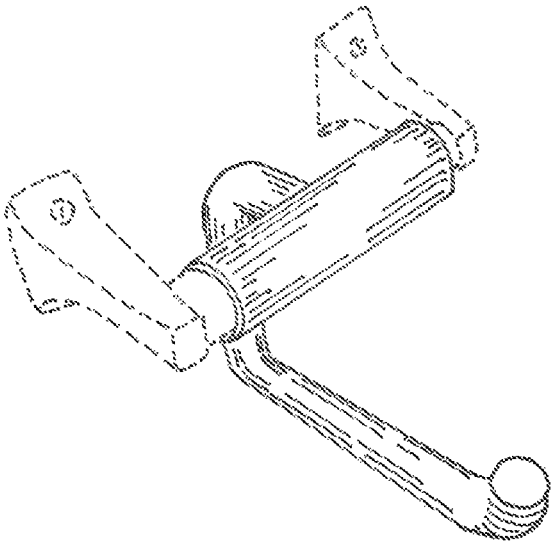
FIG. 17 is a perspective semi-top and diagonal view of a jumbo toilet paper roll holder attachment system with a pre-existing toilet paper roll spindle positioned through the hollow, cylindrical body which is attached onto a conventional toilet paper roll spindle bracket.
Figure 18:
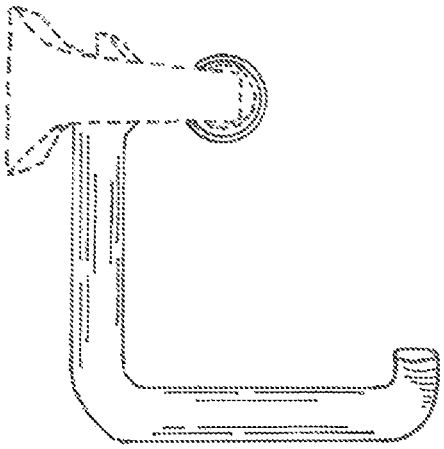
FIG. 18 is a perspective side view of a jumbo toilet paper roll holder attachment system.
Figure 19:
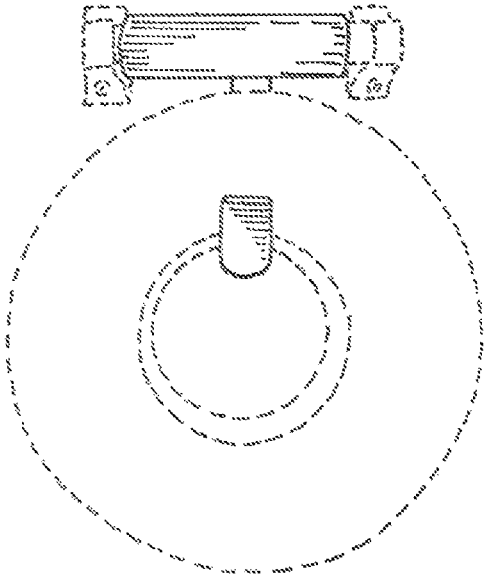
FIG. 19 is a perspective frontal view of a jumbo toilet paper roll holder attachment system with a pre-existing toilet paper roll spindle positioned through the hollow, cylindrical body attached onto a conventional toilet paper roll spindle bracket with a jumbo toilet paper roll hanging onto the horizontal shaft.
Figure 20:
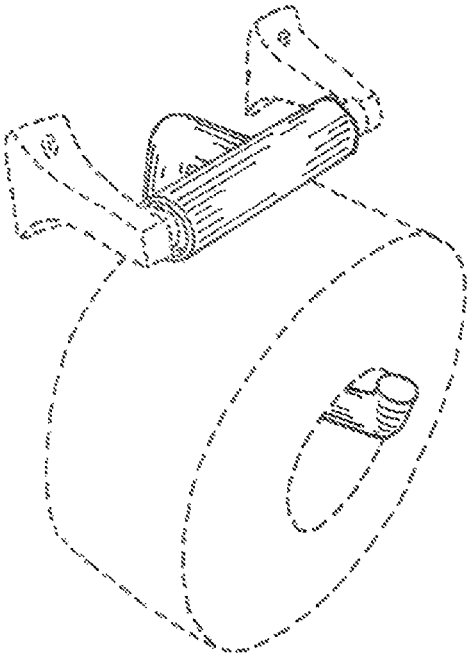
FIG. 20 is a perspective semi-top and diagonal view of a jumbo toilet paper roll holder attachment system attached to a conventional wall-mounted toilet paper roll spindle bracket with a jumbo toilet paper roll hanging onto the horizontal shaft.
Figure 21:
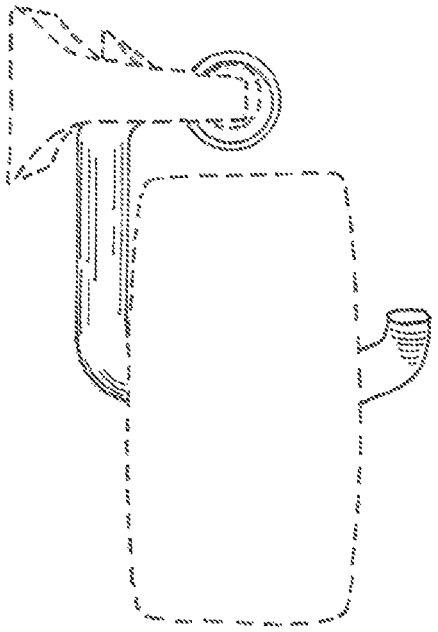
FIG. 21 is a perspective side view of a jumbo toilet paper roll holder attachment system attached to a conventional wall-mounted toilet paper roll spindle bracket with a jumbo toilet paper roll hanging onto the horizontal shaft.
Figure 22:
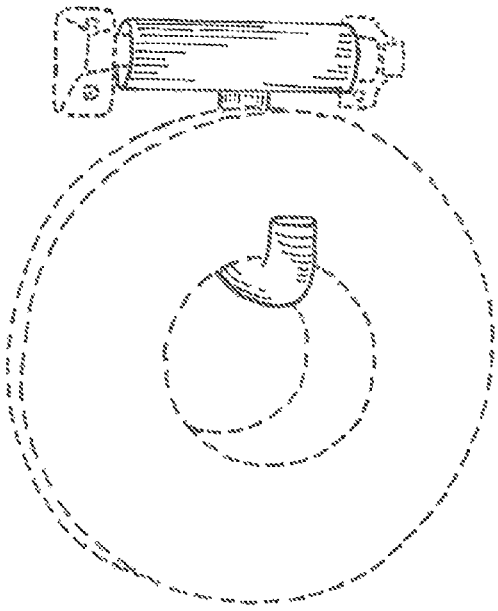
FIG. 22 is a perspective semi-frontal view of a jumbo toilet paper roll holder attachment system attached to a conventional wall-mounted toilet paper roll spindle bracket with a jumbo toilet paper roll hanging onto the horizontal shaft. Similar reference characters denote corresponding features consistently throughout the accompanying drawings.

As shown in the embodiment of FIG. 15, a jumbo toilet paper roll holder attachment system is shown at 9. The jumbo size toilet paper roll holder attachment system 9 comprises: g) a hollow, cylindrical body 10 for the purpose of insertion of a pre-existing toilet paper roll spindle, h) an inverted L-shaped bracket 11 having an upper horizontal arm and a lower end, and i) a horizontal shaft 12.

Referring to FIG. 15, the hollow, cylindrical body 10 is shorter in length than that of a pre-existing toilet paper roll spindle for easy handling when detaching and attaching the pre-existing toilet paper roll spindle into and out of the conventional wall-mounted toilet paper roll spindle bracket, once the pre-existing toilet paper roll spindle is positioned through the hollow cylindrical body 10.

Referring to FIG. 15, the apertures of both ends of the hollow cylindrical body 10 are larger than the diameter of the pre-existing toilet paper roll spindle for the purpose of having additional area of space for the insertion of the pre-existing toilet paper roll spindle through the hollow cylindrical body 10.

Referring to FIG. 15, the inverted L-shaped bracket 11, has an adequate vertical length to have a margin between the bottom side of the hollow cylindrical body 10 and the top side of the jumbo toilet paper roll.

Referring to FIG. 15, the upper horizontal arm of the inverted L-shaped bracket 11 is connected onto the middle section of the hollow, cylindrical body 10;

Referring to FIG. 15, the lower end of the inverted L-shaped bracket 11, is connected to one end of the horizontal shaft 12.

Referring to FIG. 15, the free end of the horizontal shaft 12 is angled upwards for the purpose of preventing the jumbo size toilet paper roll from sliding out of the horizontal shaft 12.

We claim:

1. A toilet paper roll holder attachment system for supporting a toilet paper roll, the toilet paper roll holder attachment system comprising: a hollow, cylindrical body member adapted to substantially hold a toilet paper roll spindle, said hollow, cylindrical body member having two apertures for fitting about a toilet paper roll spindle; an inverted L-shaped bracket member having an upper horizontal end and a lower end, said inverted L-shaped bracket member attached by said upper horizontal end to said hollow, cylindrical body member; and a horizontal shaft member secured to said lower end of said inverted L-shaped bracket member, wherein the diameter of the toilet paper roll is larger than a longitudinal length of said toilet paper roll spindle.

2. A toilet paper roll holder attachment system as recited in claim 1, wherein said inverted L-shaped bracket member secured to said hollow, cylindrical body member by epoxy resin and said horizontal shaft member is secured to said inverted L-shaped bracket member by epoxy resin.

3. A toilet paper roll holder attachment system as recited in claim 1, wherein said hollow, cylindrical body member, said inverted L-shaped bracket member, and said horizontal shaft member are formed from rigid thermoplastic material.

4. A toilet paper roll holder attachment system as recited in claim 1, wherein said apertures of said hollow cylindrical body member have an inner diameter larger than the diameter of a toilet paper roll spindle.

5. A toilet paper roll holder attachment system as recited in claim 1, wherein said hollow, cylindrical body member has a length shorter than the length of a toilet paper roll spindle when it is positioned within the toilet paper roll spindle bracket.

6. A toilet paper roll holder attachment system as recited in claim 1, wherein said inverted L-shaped bracket member has a vertical length long enough to have margin between bottom side portion of said hollow, cylindrical body member and top side portion of a toilet paper roll.

7. A toilet paper roll holder attachment system as recited in claim 1, wherein said inverted L-shaped bracket member has rubber strip on side of said inverted L-shaped bracket member facing towards wall.

8. A toilet paper roll holder attachment system as recited in claim 1, wherein said horizontal shaft member's free end is angled upwards for preventing the toilet paper roll from sliding out of said horizontal shaft member.

9. A toilet paper roll holder attachment system as recited in claim 1, wherein said horizontal shaft member has a length long enough to hold at least one toilet paper roll.

* * * * *